US008150287B2

(12) United States Patent
Souda

(10) Patent No.: US 8,150,287 B2
(45) Date of Patent: Apr. 3, 2012

(54) IMAGE FORMING APPARATUS

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 822 days.

(21) Appl. No.: 12/199,579

(22) Filed: Aug. 27, 2008

(65) Prior Publication Data

US 2009/0060548 A1 Mar. 5, 2009

(30) Foreign Application Priority Data

Aug. 30, 2007 (JP) ..... 2007-224139

(51) Int. Cl.
*G03G 15/20* (2006.01)

(52) U.S. Cl. ..... 399/68; 399/388; 399/397; 399/400; 399/405

(58) Field of Classification Search ..... 399/68, 399/397, 400
See application file for complete search history.

(56) References Cited

U.S. PATENT DOCUMENTS

| | | | | |
|---|---|---|---|---|
| 4,941,021 | A * | 7/1990 | Uchida et al. | 399/322 |
| 5,016,057 | A * | 5/1991 | Nakajima et al. | 399/320 |
| 5,745,832 | A * | 4/1998 | Yoshiuchi | 399/384 |
| 6,823,149 | B2 * | 11/2004 | Yoshikawa et al. | 399/68 |
| 6,892,038 | B2 * | 5/2005 | Fukutani | 399/68 |
| 7,398,027 | B2 * | 7/2008 | Koshida et al. | 399/68 |
| 7,426,353 | B1 * | 9/2008 | Sakakibara | 399/68 |
| 7,787,803 | B2 * | 8/2010 | Ahn et al. | 399/167 |
| 8,006,976 | B2 * | 8/2011 | Suzuki et al. | 271/270 |
| 8,050,609 | B2 * | 11/2011 | Kobayashi et al. | 399/328 |
| 2004/0037600 | A1 * | 2/2004 | Eda | 399/388 |
| 2006/0151941 | A1 * | 7/2006 | Farmer et al. | 271/264 |
| 2006/0222386 | A1 * | 10/2006 | Koshida et al. | 399/44 |
| 2006/0251439 | A1 * | 11/2006 | Sugiyama | 399/68 |
| 2007/0059071 | A1 * | 3/2007 | Shinshi et al. | 399/400 |
| 2008/0080910 | A1 * | 4/2008 | Senda et al. | 399/328 |
| 2009/0087235 | A1 * | 4/2009 | Senda et al. | 399/329 |
| 2009/0208236 | A1 * | 8/2009 | Katsura et al. | 399/68 |
| 2009/0208261 | A1 * | 8/2009 | Kobayashi et al. | 399/328 |

FOREIGN PATENT DOCUMENTS

| | | | |
|---|---|---|---|
| JP | 62-178291 A | | 8/1987 |
| JP | 5-094110 A | | 4/1993 |
| JP | 06161317 A | * | 6/1994 |
| JP | 6-250550 A | | 9/1994 |
| JP | 8-95419 A | | 4/1996 |
| JP | 9-258595 A | | 10/1997 |
| JP | 10-247024 A | | 9/1998 |
| JP | 11-84782 A | | 3/1999 |
| JP | 2002169403 A | * | 6/2002 |
| JP | 2003-316229 A | | 11/2003 |
| JP | 2004-109169 A | | 4/2004 |

OTHER PUBLICATIONS

English machine translation of Japanese patent document Suzuki (JP 2002-169403 A).* English machine translation of Japanese patent document Sasaki et al. (JP 06-161317 A).*
English machine translation of Japanese patent document Hara (JP 09-258595 A).*
JP Office Action dtd Aug. 4, 2009, JP Appln. 2007-224139, partial English Translation.

* cited by examiner

*Primary Examiner* — David Gray
*Assistant Examiner* — Geoffrey Evans
(74) *Attorney, Agent, or Firm* — Banner & Witcoff, Ltd

(57) ABSTRACT

An image forming apparatus is configured to form a developer image on a recording sheet. The image forming apparatus includes a fixing unit including a pressure roller and a heat roller, an ejection roller configured to cause the recording sheet from the fixing unit to be ejected from the image forming apparatus, and a power transmission member configured to transmit power from the heat roller to cause the ejection roller to rotate. The pressure roller is configured to rotate in response to power and configured to cause the heat roller to be rotated.

12 Claims, 5 Drawing Sheets

IMAGE FORMING APPARATUS

CROSS REFERENCE TO RELATED APPLICATION

This application claims priority from Japanese Patent Application No. 2007-224139, filed on Aug. 30, 2007, the entire subject matter of which is incorporated herein by reference.

FIELD

Aspects of the invention relate to image forming apparatuses including a fixing device having a pressure roller and a heat roller, and an ejection roller configured to convey a recording sheet from the fixing device to outside of the apparatus.

BACKGROUND

A known image forming apparatus, e.g., a laser printer, includes a fixing device that is configured to fix a developer image transferred onto a recording sheet by heat and an ejection roller that is configured to convey the recording sheet from the fixing device to the outside of the apparatus. A known fixing device includes a heat roller that is subjected to heat by a heating device and a pressure roller pressed against the heat roller.

The fixing device is configured in which the pressure roller is rotated by power from a drive source and then the heat roller is rotated by the rotation of the pressure roller. In the fixing device, a speed of conveying a recording sheet to be ejected from the fixing device (hereinafter referred to as a fixing speed) is determined according to a peripheral speed of the pressure roller.

If the fixing speed is too small relative to a speed of conveying a recording sheet at the ejection roller (hereinafter referred to as sheet ejection speed), the ejection roller may pull the recording sheet. In this case, the ejection roller may slip on the recording sheet, and it may leave marks on the recording sheet. Alternatively, the heat roller may slip on the recording sheet, and a developer image on the recording sheet may be scraped, which may result in image quality deterioration.

If the fixing speed is too large relative to the sheet ejection speed, the recording sheet may be warped between the fixing device and the ejection roller. In this case, jamming may occur in between the fixing device and the ejection roller, or a developer image on the recording sheet may be scraped in contact with a frame within the apparatus, which may result in image quality deterioration.

As described above, when a difference between the fixing speed and the sheet ejection speed exceeds given bounds, image quality may become deteriorated or jamming may occur. Thus, the difference between the fixing speed and the ejection speed preferably remains within a specified range.

SUMMARY

However, as the pressure roller is coated with a relatively thick elastic layer, its outer diameter may change due to thermal expansion, and thus its peripheral speed may change even with the rotation speed of the driving shaft remaining unchanged. Thus, because the fixing speed may change as the outer diameter of the pressure roller changes, it is difficult to keep the difference between the fixing speed and the ejection speed within a specified range in the fixing device that drives the pressure roller.

Aspects of the invention provide an image forming apparatus provide an image forming apparatus configured to reduce image quality deterioration and jamming occurrences by keeping the difference between the fixing speed and the ejection speed within a specified range.

BRIEF DESCRIPTION OF THE DRAWINGS

Illustrative aspects of the invention will be described in detail with reference to the following figures in which like elements are labeled with like numbers and in which.

DETAILED DESCRIPTION

Figure 1:
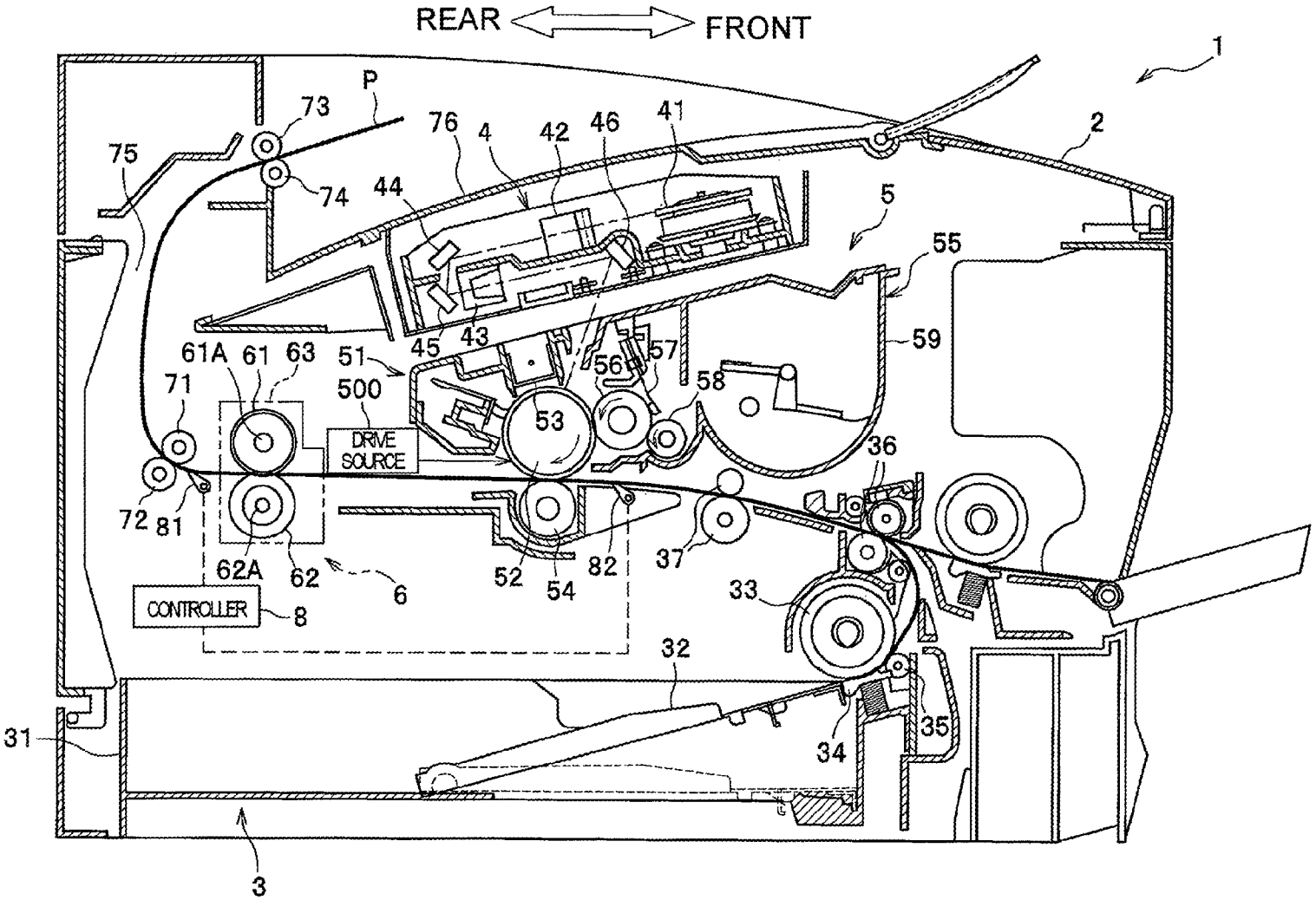
FIG. 1 is a side sectional view of an internal structure of a laser printer as an illustrative example of an image forming apparatus according to an illustrative embodiment of the invention.

An illustrative embodiment of the invention will be described in detail with reference to the accompanying drawings. An image forming apparatus according to aspects of the invention applies to a laser printer 1 as shown in FIG. 1. It will be appreciated that aspects of the invention apply to other types of image forming apparatuses as well.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

As shown in FIG. 1, the laser printer 1 may include, in a body casing 2, a sheet supply section 3, a light exposure unit 4, a process cartridge 5, a fixing unit 6, and a controller 8. The sheet supply section 3 is configured to supply a recording sheet, e.g., a sheet P. The process cartridge 5 is configured to transfer an image of developer, e.g., toner, onto the sheet P. The fixing unit 6 is configured to fix the toner image onto the sheet by heat.

The sheet supply section 3 may include a sheet supply tray 31, a sheet pressing plate 32, a pickup roller 33, a separation pad 34, dust removing rollers 35, 36, and registration rollers 37. The sheet supply tray 31 is disposed in a lower portion of the body casing 2 and configured to be attached to and removed from the body casing 2. The pickup roller 33 and the separation roller 34 are disposed in a front upper portion of the sheet supply tray 31. The dust removing rollers 35, 36 are disposed at a downstream side from the pickup roller 33 in a direction where the sheet P is conveyed (hereinafter referred to as the sheet conveyance direction). The registration rollers 37 are disposed at the downstream side from the dust removing rollers 35, 36 in the sheet conveyance direction.

In the sheet supply section 3, a sheet P in a stack of sheets P in the sheet supply tray 31 is moved to the pickup roller 33 by the sheet pressing plate 32, singly conveyed by the pickup roller 33 and the separation pad 34, passed through the dust removing rollers 35, 36 and the registration rollers 37, and conveyed to a position where a photosensitive drum 52 and a transfer roller 54 face each other.

The exposure unit 4 is disposed in an upper portion of the body casing 2. The exposure unit 4 may include a polygon mirror 41, lenses 42, 43, and reflecting mirrors 44, 45, 46. In the exposure unit 4, as shown in a broken line, a laser beam emitted from a laser emitting portion (not shown), based on image data, may be deflected by the polygon mirror 41, pass through the lens 42, be folded by the reflecting mirrors 44, 45, pass through the lens 43, and be bent downward by the reflecting mirror 46, to be directed to a surface of the photosensitive drum 52 in the process cartridge 5 at high speed scanning.

The process cartridge 5 is disposed under the exposure unit 4, and is configured to be attached to and removed from the body casing 2. The process cartridge 5 includes a cartridge frame 51 that is hollow and serves as an outer frame. The process cartridge 5 further includes a photosensitive member, e.g., a photosensitive drum 52, a scorotron charger 53, a transfer member, e.g., a transfer roller 54, and a developer cartridge 55 in the cartridge frame 51.

The developer cartridge 55 is mounted in the cartridge frame 51 in a detachable manner. The developer cartridge 55 includes a developing roller 56, a layer-thickness regulating blade 57, a supply roller 58, and a toner chamber 59. Developer, e.g., toner, stored in the toner chamber 59, is supplied to the developing roller 56 along with the rotation of the supply roller 58. At this time, toner is electrically charged between the supply roller 58 and the developing roller 56 by friction. The toner supplied to the developing roller 56 goes in between the layer-thickness regulating blade 57 and the developing roller 56 along with the rotation of the developing roller 56, and is carried on the developing roller 56 as a thin layer having a constant thickness.

The photosensitive drum 52 is rotatably supported by the cartridge frame 51. The photosensitive drum 52 includes a drum body that is grounded and an outer surface thereof that is formed of a photosensitive layer.

The transfer roller 54 is disposed below the photosensitive drum 52, contacting the photosensitive drum 52 from below, and rotatably supported by the cartridge frame 51. During image transfer, a bias is applied to the transfer roller 54.

Hereinafter, a position in which the photosensitive drum 52 and the transfer roller 54 face and contact each other is referred to as a facing position.

In the process cartridge 5, the surface of the photosensitive drum 52 is uniformly and positively charged by the scorotron charger 53, and then is exposed to a laser beam emitted from the exposure unit 4 by high-speed scanning. An electric potential in the exposed area of the surface of the photosensitive drum 52 becomes low, and an electrostatic latent image is formed based on the image data.

When the developing roller 56 is rotated, toner carried on the developing roller 56 is supplied to the electrostatic latent image formed on the surface of the photosensitive drum 52. As toner is selectively carried on the surface of the photosensitive drum 52, the latent image on the photosensitive drum 52 becomes visible, and a toner image is formed by reversal.

The power is supplied to the photosensitive drum 52 and the transfer roller 54, which are rotated to convey the sheet P therebetween. When the sheet P is conveyed between the photosensitive drum 52 and the transfer roller 54, a toner image carried on the photosensitive drum 52 is transferred onto the sheet P.

The fixing unit 6 may be disposed at the rear of the process cartridge 5 or at a downstream side of the process cartridge 5 in the sheet conveyance direction. The fixing unit 6 may include a heat roller 61, a pressure roller 62 configured to be pressed against the heat roller 61, and a frame member 63 supporting the heat roller 61 and the pressure roller 62.

The heat roller 61 is formed in a generally cylindrical shape, and has a heating member such as a halogen heater therein and a rotation shaft 61A protruding axially from both ends of the heat roller 61. The heat roller 61 is configured such that a surface thereof becomes heated to a temperature for fixing toner by the heating member and the rotation shaft 61A is rotatably supported by the frame member 63. The heat roller 61 is rotated along with the rotation of the pressure roller 62. That is, the heat roller 61 is rotated by a frictional force with a peripheral surface of the pressure roller 62 or by a frictional force with the sheet P conveyed by the pressure roller 62.

The pressure roller 62 is cylindrically shaped, and includes a metal core bar, and an elastic member, e.g., a urethane rubber, which is formed around the metal core bar. A rotation shaft 62A protrudes outward from each end of the metal core bar, and is supported via the arm member 64 by the frame member 63.

Ejection rollers 71, 72, 73, 74 and a sheet ejection path 75 are provided at the downstream side from the fixing unit 6 in the sheet conveyance direction, so as to eject the sheet P conveyed from the fixing unit 6 out of the body casing 2. The ejection roller 71 is configured to be rotated when receiving power from the heat roller 61.

In the fixing unit 6 configured above, the toner image transferred on the sheet P is thermally fixed while the sheet P passes between the heat roller 61 and the pressure roller 62. Then, the sheet P is conveyed to the ejection path 75 by the ejection rollers 71, 72, and ejected onto an ejection tray 76 by the ejection rollers 73, 74.

A detailed structure of the fixing unit 6 and a mechanism to transmit power of the drive source 22 to the ejection roller 71 via the heat roller 61 will be described.

Figure 2:
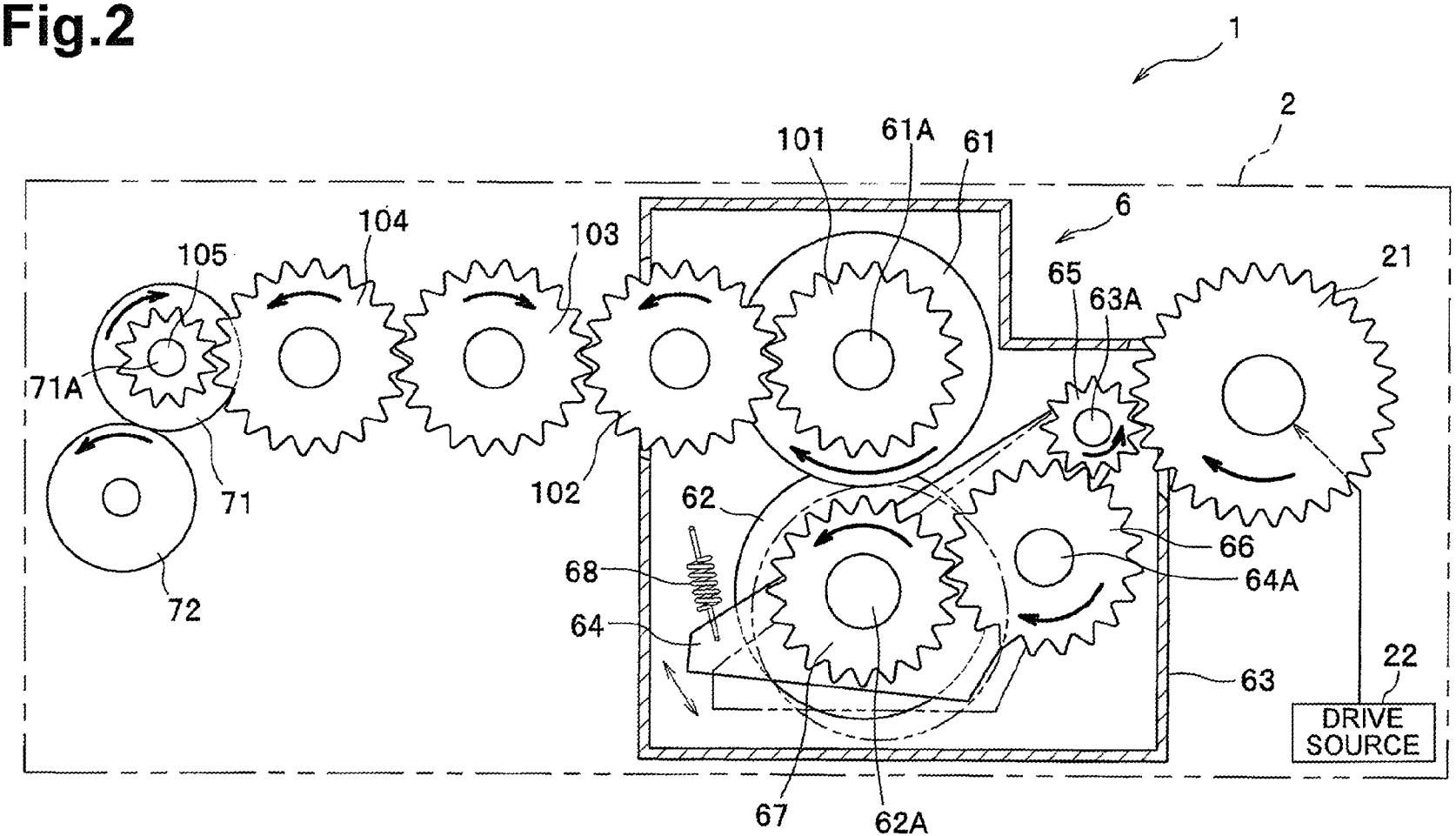
FIG. 2 is a left side view schematically showing a drive power transmission mechanism from a heat roller to an ejection roller and a moving mechanism for a pressure roller.

As shown in FIG. 2, the fixing unit 6 further includes, in the frame member 63, arm members 64 (only one shown), an input gear 65, an intermediate gear 66, and a drive gear 67, which are disposed in proximity to an output gear 21 disposed in the body casing 2. Power from a drive source 22, e.g., a motor, disposed in the body casing 2, is transmitted via gears (not shown) to the output gear 21. In this illustrative embodiment, the drive source for the fixing unit 6 and a drive source 500 for the photosensitive drum 52 and the transfer roller 54 in the process cartridge 5 are disposed individually.

A transmission gear 101 is fixed to a left end of the rotation shaft 61A of the heat roller 61 protruding outward from the frame member 63.

The rotation shaft 62A of the pressure roller 62 is rotatably supported at both ends thereof by the arm members 64. A drive gear 67 is fixed to a left end of the rotation shaft 62A protruding outward from the left arm member 64.

The arm members 64 are disposed on both ends of the pressure roller 62, and are formed from a metal plate by punching. Each arm member 64 is rotatably supported at one end to a support shaft 63A disposed in the frame member 63 and attached at the other end to one end of an extension spring 68. The other end of the extension spring 68 is attached to the frame member 63 at a higher position than the arm member 64. Thus, the arm members 64 are configured to oscillate.

The arm members 64 rotatably support rotation shaft 62A of the pressure roller 62 at a location some distance from one end in a range between one end and the other end of each arm member 64. Thereby, the pressure roller 62 is configured to oscillate relative to the heat roller 61 and the frame member 63. As each arm member 64 is urged toward the heat roller 61 under a force applied from the extension spring 68, the pressure roller 62 is urged or pressed toward the heat roller 61.

The input gear 65 is rotatably supported by the support shaft 63A of the frame member 63 at a position to engage with the output gear 21 disposed in the body casing 2. The support shaft 63A of the frame member 63, which functions as a rotation shaft for the input gear 65, is immovably provided in the frame member 63, and the input gear 65 and the output gear 21 are consistently maintained in engagement with each other.

The intermediate gear 66 engages the input gear 65 and the drive gear 67, and is rotatably supported by a support shaft 64A provided on the left arm member 64. Thus, the intermediate gear 66 pivots on the input gear 65 along with the movement of the arm member 64.

The drive gear 67 is fixed to the left end of the rotation shaft 62A of the pressure roller 62. The drive gear 67 rotates integrally with the pressure roller 62 and pivots on the input gear 65 along with the movement of the arm member 64. As the drive gear 67 is connected to the input gear 65 via the intermediate gear 66, power is transmitted from the drive source 22 to the drive gear 67 via the input gear 65 and the intermediate gear 66.

Power from the heat roller 61 to the ejection roller 71 is transmitted by a power transmission member, e.g., transmission gears 101, 102, 103, 104, 105.

The transmission gear 101 is fixed to the left end of the rotation shaft 61A of the heat roller 61, and thus rotates integrally with the heat roller 62.

The transmission gears 102, 103, 104 are rotatably supported in the body casing 2. The transmission gear 102 engages the transmission gears 101, 103 and is configured to transmit power of the transmission gear 101 to the transmission gear 103. The transmission gear 103 engages the transmission gears 102, 104, and is configured to transmit power of the transmission gear 102 to the transmission gear 104. The transmission gear 104 engages the transmission gears 103, 105, and is configured to transmit power of the transmission gear 103 to the transmission gear 105.

The transmission gear 105 is fixed to the left end of the rotation shaft 71A of the ejection roller 71 that is rotatably supported in the body casing 2. The transmission gear 105 rotates integrally with the ejection roller 71. As the transmission gear 105 is connected to the transmission gear 101 via the transmission gears 102, 103, 104, it receives power of the heat roller 61 via the transmission gears 101, 102, 103, 104.

A gear ratio of the transmission gears 101, 102, 103, 104, 105 is set so that a peripheral speed of the heat roller 61 is generally the same as (i.e., approximates) that of the ejection roller 71, in other words, the difference between the peripheral speed of the heat roller 61 and the peripheral speed of the ejection roller 71 falls within a specified range.

In the power transmission mechanism configured above, power from the drive source 22 is transmitted to the output gear 21 via a plurality of gears (not shown). The power of the output gear 21 is transmitted to the drive gear 67 via the input gear 65 and the intermediate gear 66, causing the pressure roller 62 to rotate. The power of the pressure roller 62 causes the heat roller 61 pressed in contact with the pressure roller 62 to rotate. The power of the heat roller 61 is transmitted via the transmission gears 101-104 to the transmission gear 105, which causes the ejection roller 71 to rotate and then causes the ejection roller 72 contacting the ejection roller 71 to rotate. At this time, the difference between the peripheral speed of the heat roller 61 and the peripheral speed of the ejection roller 71 is kept within a specified range.

As shown in FIG. 1, the controller 8 is disposed in the body casing 2, and connected to a first sensor 81 and a second sensor 82. The first and second sensors 81 are configured to output detection results to the controller 8. The controller 8 may include a CPU, RAM, ROM, and an input circuit, which are not shown, and be configured to control the rotation of the heat roller 61, that is, the drive source 22 that rotates the pressure roller 62 via gears, based on inputs from the first and second sensors 81, 82 and programs and data stored in the ROM.

The first sensor 81 is disposed in the body casing 2 and positioned on a path where the sheet P is convened between the fixing unit 6 and the ejection rollers 71, 72. The first sensor 81 is configured to detect leading and trailing ends of the sheet P being conveyed from the fixing unit 6 in the sheet conveyance direction. Hereinafter, a leading end of a sheet P with respect to the sheet conveyance direction may be referred to as just a leading end, and a trailing end of a sheet P with respect to the sheet conveyance direction may be referred to as just a trailing end.

The second sensor 82 is disposed in the cartridge frame 51, and on a path where the sheet P is conveyed on an upstream side with respect to the sheet conveyance direction from the facing position between the photosensitive drum 52 and the transfer roller 54, in other words, on the path between the facing position and the registration rollers 37. The second sensor 82 is configured to detect the leading and trailing end of the sheet P being conveyed on the path in the sheet conveyance direction. The second sensor 82 may be disposed in the body casing 2.

Each sensor 81, 82 may be made up of an oscillating arm that is disposed to contact the sheet P at one end and an optical sensor that detects the movement of the oscillating arm. According to such a configuration, each sensor 81, 82 can detect a state where the sheet P contacts the oscillating arm and a state where the sheet P does not contact the oscillating arm, and can detect that the leading end and the trailing end of the sheet P being conveyed on the path has passed.

More specifically, when the oscillating arm may change from a stand-up position to a fall-down position in response to the sheet P contacting one end of the oscillating arm, for example, light emitted from the optical sensor may be cut off by the oscillating arm in the fall-down position. Thus, each sensor 81, 82 can detect that the leading end of the sheet P has passed. In addition, when the sheet P completely passes and the oscillating arm returns to the stand-up position, for example, an object to cut off the light emitted from the optical sensor may disappear. Thus, the sensors 81, 82 can detect that the leading end of the sheet P has passed. See FIGS. 5A to 5D.

Alternatively, the sensors 81, 82 may be optical sensors configured to detect the passage of the leading end and the trailing end of the sheet P with light being emitted from the optical sensors.

Figure 3:
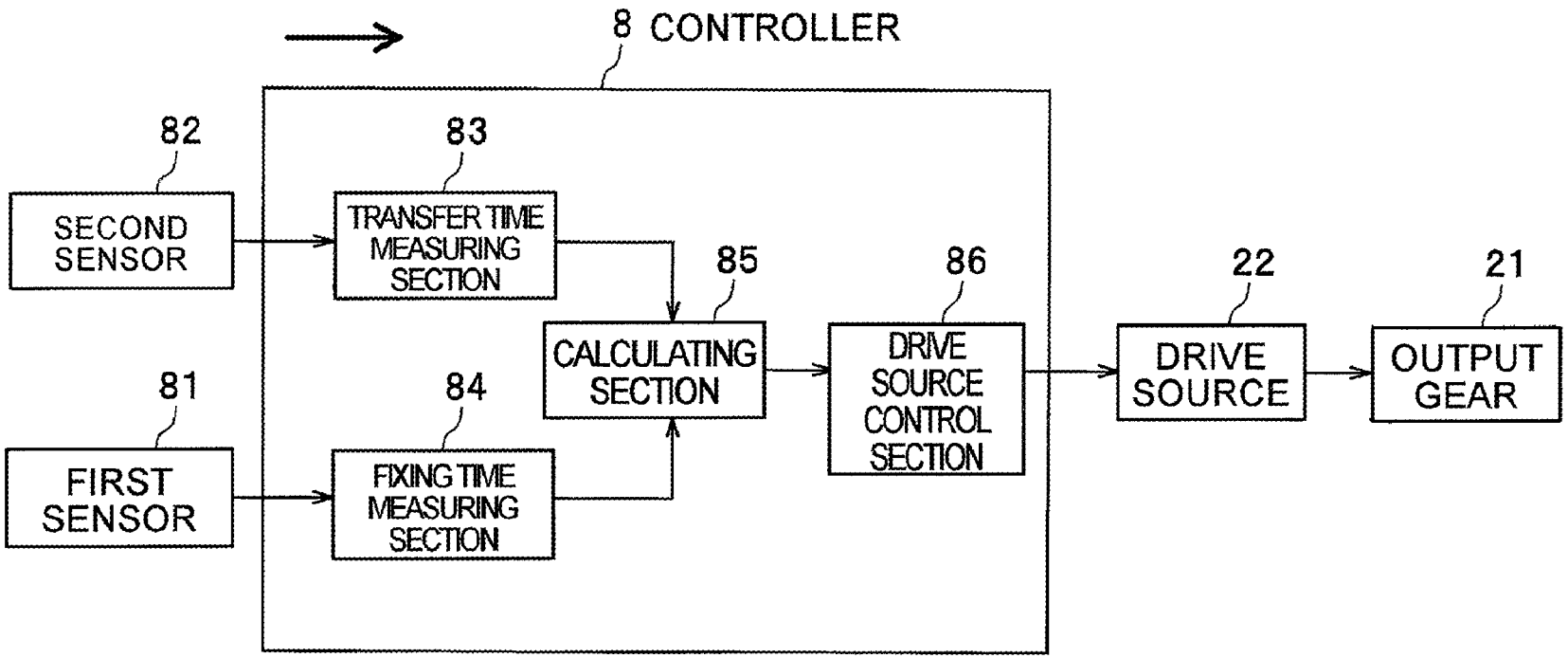
FIG. 3 is a block diagram showing an illustrative structure of a controller.

As shown in FIG. 3, the controller 8 includes computer software modules stored in one or more computer readable media (e.g., RAM, ROM) and executable by the CPU. The computer software modules include a transfer time measuring section 83, a fixing time measuring section 84, calculating section 85, and a drive source control section 86.

The transfer time measuring section 83 is configured to measure a time from when the leading end of the sheet P passes the second sensor 82 to when the trailing end of the sheet P passes the second sensor 82, based on detection by the second sensor 82, and to output the measured time to the calculating section 85. In this illustrative embodiment, the time measured by the transfer time measuring section 83 (hereinafter referred to as transfer time) is approximated to a time from when the leading end of the sheet P passes the facing position to when the trailing end of the sheet P passes the facing position. This approximation can be made because the registration rollers 37 are accurately controlled such that the difference between the conveyance speed at the registration rollers 37 and the conveyance speed at the photosensitive drum 52 is kept within a specified range.

The fixing time measuring section 84 is configured to measure a time from when the leading end of the sheet P passes the first sensor 81 to when the trailing end of the sheet P passes the first sensor 81, based on detection by the first sensor 81, and to output the measured time to the calculating section 85. In this illustrative embodiment, the time measured by the fixing time measuring section 84 (hereinafter referred to as fixing time) is approximated to a time from when the leading end of the sheet P passes between the heat roller 61 and the pressure roller 62 to when the trailing end of the sheet P passes between the heat roller 61 and the pressure roller 62. This approximation can be made with the above configuration because the difference between a conveyance speed of the sheet P ejected from the fixing unit 6 and a conveyance speed of the sheet P at the ejection rollers 71, 72 is kept within a specified range.

The calculating section 85 is configured to calculate a difference between the transfer time input by the transfer time measuring section 83 and the fixing time input by the fixing time measuring section 84, and to output the difference to the drive source control section 86.

The drive source control section 86 is configured to control the drive source 22 based on the difference between the transfer time and the fixing time. For example, when the drive source 22 is a motor, the drive source control section 86 determines a rotation speed of the motor to drive the motor. More specifically, when the difference between the transfer time and the fixing time is less than a threshold value, the drive source control section 86 does not change the rotation speed of the drive source 22. When the difference exceeds the threshold value, the drive source control section 86 changes the rotation speed of the drive source 22 according to the relationship between the transfer time and the fixing time. For example, when the fixing time is less than the transfer time, the drive source control section 86 increases the rotation speed of the drive source 22, and when the fixing time is greater than the transfer time, the drive source control section 86 decreases the rotation speed of the drive source 22.

Operations of the controller 8 configured above will be described. The controller 8 repeats processes from start to end in a flowchart of FIG. 4.

Figure 5A:
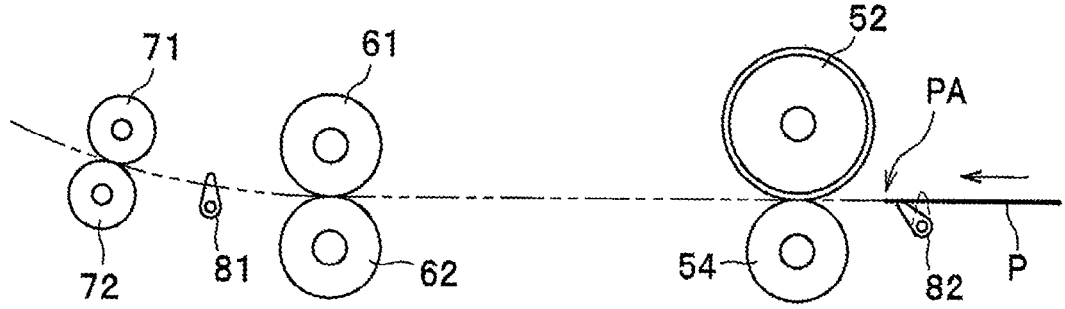
FIGS. 5A to 5D illustrate how transfer time and fixing time are measured.
Figure 5B:
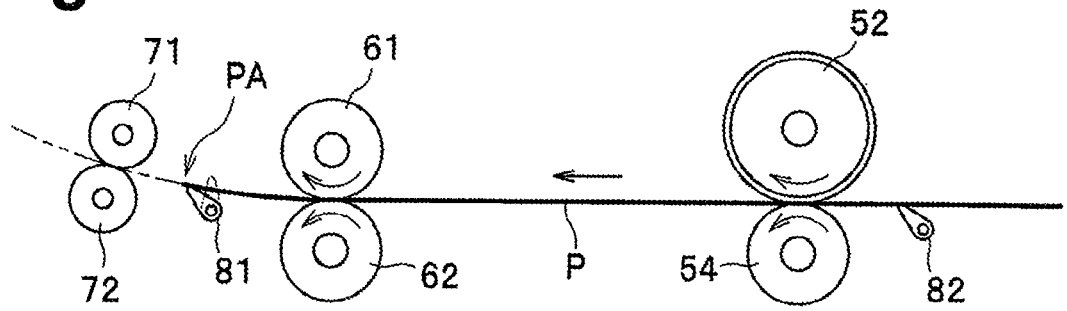

The controller 8 causes the transfer time measuring section 83 to measure the transfer time based on an output value of the second sensor 82 (S1). The controller 8 causes the fixing time measuring section 84 to measure the fixing time based on an output value of the first sensor 81 (S2). More specifically, as shown in FIG. 5A, when the second sensor 82 detects that a leading end PA of the sheet P passes the second sensor 82, the transfer time measuring section 83 starts measuring time. As shown in FIG. 5B, when the first sensor 81 detects that the leading end PA of the sheet P passes between the photosensitive drum 52 and the transfer roller 54, between the heat roller 61 and the pressure roller 62, and then the first sensor 81, the fixing time measuring section 84 starts measuring time.

Figure 5C:
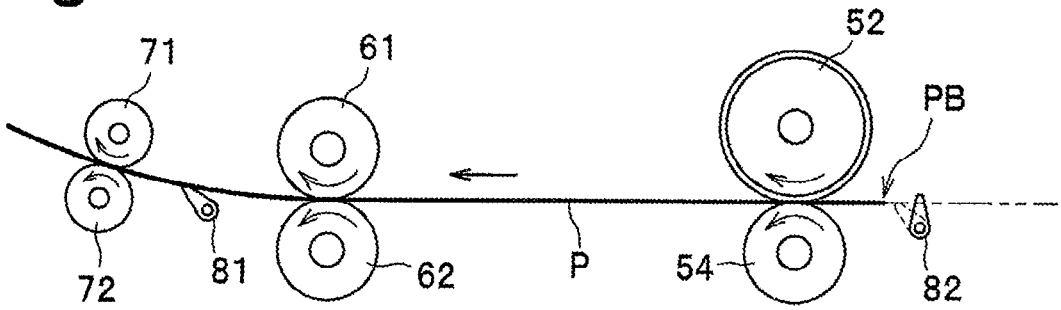
Figure 5D:
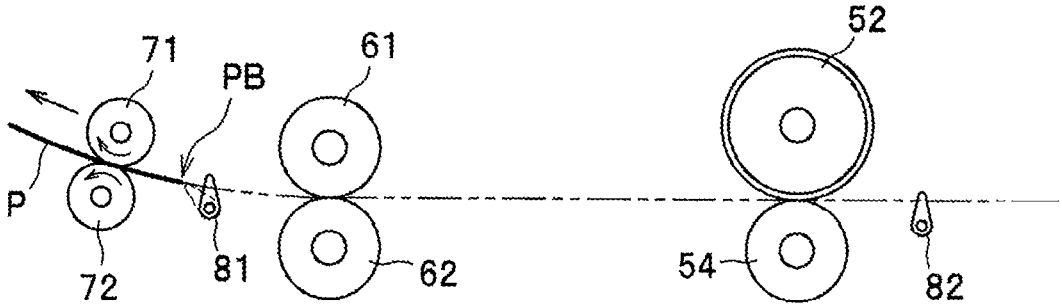

As shown in FIG. 5C, when the second sensor 82 detects that a trailing end PB of the sheet P passes the second sensor 82, the transfer time measuring section 83 stops measuring the time and determines the transfer time. As shown in FIG. 5D, when the first sensor 81 detects that the trailing end PB of the sheet P passes between the photosensitive drum 52 and the transfer roller 54, between the heat roller 61 and the pressure roller 62, and then the first sensor 81, the fixing time measuring section 84 stops measuring the time and determines the fixing time. When the dimension of the sheet P in the sheet conveyance direction is smaller than a distance between the first sensor 81 and the second sensor 82, the second sensor 82 firstly detects the leading and trailing ends of the recording sheet to measure the transfer time, and the first sensor 81 secondly detects the leading end of the recording sheet to start measuring the fixing time.

Figure 4:
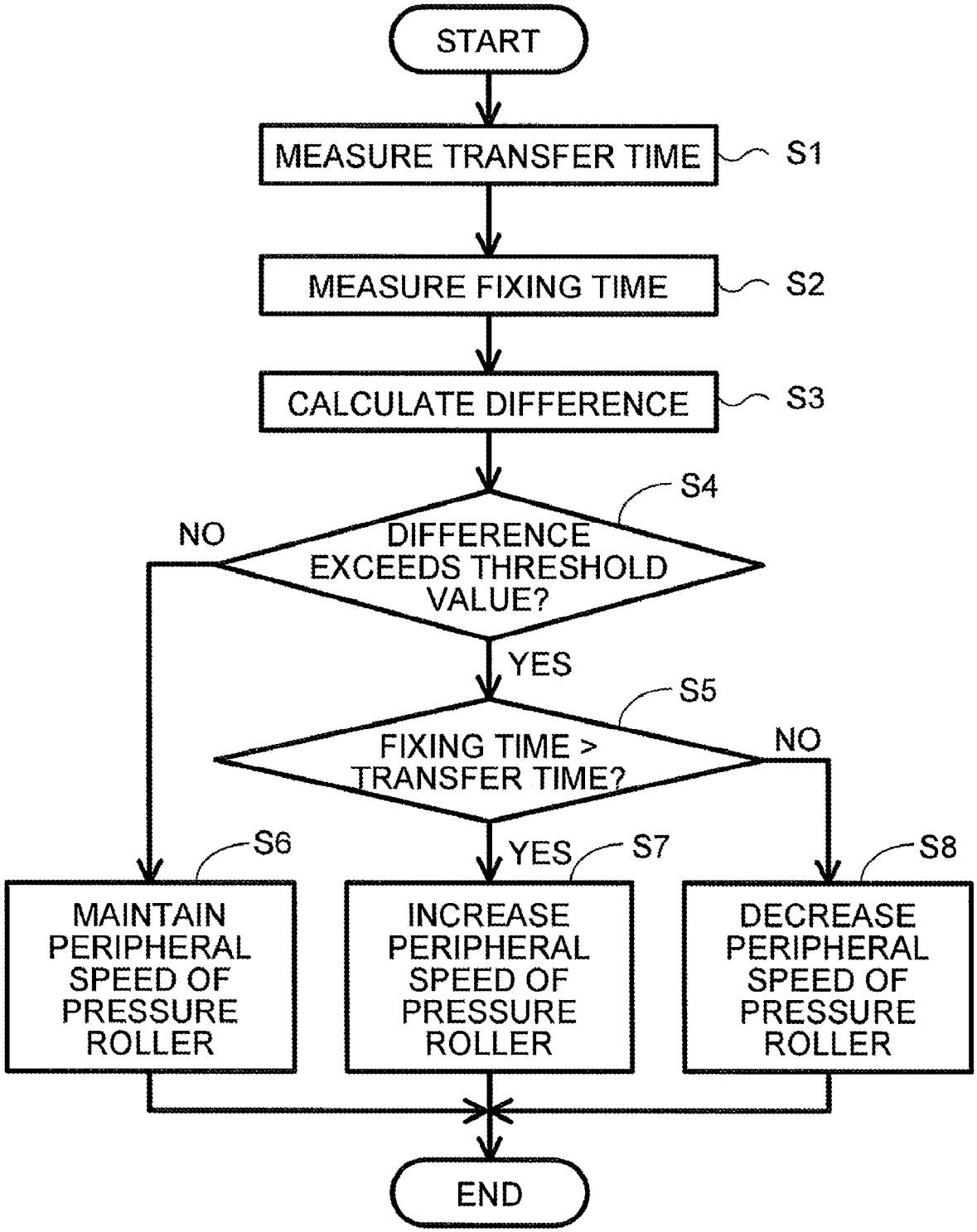
FIG. 4 is a flowchart showing illustrative operations of the controller.

As shown in FIG. 4, the controller 8 causes the calculating section 85 to calculate the difference between the transfer time and the fixing time (S3). The controller 8 causes the drive source control section 86 to determine whether the difference between the transfer time and the fixing time exceeds the threshold value (S4). When the difference does not exceeds the threshold value (S4: No), that is, when the difference is smaller than or equal to the threshold value, the controller 8 controls the rotation speed of the drive source 22 for the next printing operation to be the same speed as the speed for the current printing operation, and maintains a peripheral speed of the pressure roller 62 (S5).

When the difference exceeds the threshold value (S4: Yes), the controller 8 determines the relationship between the fixing time and the transfer time (S5). When the fixing time is greater than the transfer time (S5: Yes), the controller 8 controls the rotation speed of the drive source 22 such that the rotation speed for the next printing operation is greater than the rotation speed set in the current printing operation, and increase the peripheral speed of the pressure roller 62 (S7). When the fixing time is not greater than the transfer time (S5: No), for example when the fixing time is smaller than the transfer time, the controller 8 controls the rotation speed of the drive source 22 such that the rotation speed for the next printing operation is smaller than the rotation speed set in the current printing operation, and decreases the peripheral speed of the pressure roller 62 (S8).

At the next printing operation, the difference between the peripheral speed of the pressure roller 62, which is a conveyance speed of the sheet P ejected from the fixing unit 6, and the peripheral speed of the photosensitive drum 52 or the transfer roller 54, which is a conveyance speed of the sheet P ejected from the facing position between the photosensitive drum 52 and the transfer roller 54, can be kept within a specified range. The peripheral speeds of the heat roller 61 and the ejection roller 71 vary with the peripheral speed of the pressure roller 62. However, the heat roller 61 and the ejection roller 71 are connected via the transmission gears 101 to 105, and thus the peripheral speed becomes generally the same among the pressure roller 62, the heat roller 61 and the ejection roller 71.

According to the above illustrative embodiment, the following advantages may be obtained.

The heat roller 61 and the ejection roller 71 are connected via the transmission gears 101 to 105 to transmit power from the heat roller 61 to the ejection roller 71. Even if the outer diameter of the pressure roller 62 changes and the peripheral speed of the pressure roller 62 and the peripheral speed of the heat roller 61 contacting the pressure roller 62 change, the difference between the peripheral speed of the heat roller 61 and the peripheral speed of the ejection roller 71 can be maintained within a specified range.

As a result, the conveyance speed of the sheet P ejected from the fixing unit 6 and the conveyance speed of the sheet P between the ejection rollers 71, 72 can be maintained within a specified range, so as to prevent the sheet P from being pulled by the ejection rollers 71, 72 and from being warped between the fixing unit 6 and the ejection rollers 71, 72. Thus, marks of the ejection rollers 71, 72 on the sheet P may be minimized, and deterioration of image quality due to scraped toner image on the sheet P and jamming between the fixing unit 6 and the ejection rollers 71, 72 may be reduced.

The controller 8 may maintain a difference between the conveyance speed of the sheet P ejected from the fixing unit 6 (fixing speed) and the conveyance speed of the sheet P ejected from the facing position between the photosensitive drum 52 and the transfer roller 54 (the transfer speed) within a specified range. More specifically, when the difference between the fixing speed and the transfer speed is within the specified range, the difference may be kept within a specified range by adjusting the fixing speed to approximate the transfer speed.

That is, the difference between the fixing speed and the transfer speed is controlled to be kept within a specified range, the heat roller 61 and the pressure roller 62 may be prevented from pulling the sheet P, and the sheet P may be prevented from being warped between the process cartridge 5 and the fixing unit 6. Thus, marks of the photosensitive drum 52 or the transfer roller on the sheet P may be minimized, and deterioration of image quality due to scraped toner image on the sheet P and jamming between the process cartridge 5 and the fixing unit 6 may be reduced.

In the structure that the difference between the fixing speed and the conveyance speed of the sheet P by the ejection rollers 71, 72 is kept within the specified range as described in the illustrative embodiment. Also, the sheet P is conveyed between the ejection rollers 71, 72 at the same speed as when the sheet P is ejected from the fixing unit 6. Thus, by disposing the first sensor 81 on a conveyance path of the sheet P between the fixing unit 6 and the ejection rollers 71, 72, the fixing speed can be accurately measured based on the output value of the first sensor 81. As the fixing time can be accurately measured in this manner, the difference between the fixing speed and the transfer speed can be maintained within the specified range. Thus, deterioration of image quality due to scraped toner image on the sheet P and jamming between the process cartridge 5 and the fixing unit 6 may be reduced.

As the peripheral speed of the pressure roller 62 is controlled to conform to the peripheral speed of the photosensitive drum 52 or the transfer roller 54, the peripheral speed of the photosensitive drum 52 or the transfer roller 54 may be maintained. To change the peripheral speed of the photosensitive drum 52 or the transfer roller 54, for example, the scanning speed of a laser beam to be directed from the light exposure unit 4 to the photosensitive drum 52 needs to be changed, and the structure of the light exposure unit 4 also needs to be changed as well as that of the process cartridge 5. However, in this illustrative embodiment, it is only the structure of the fixing unit 6 that needs to be need changed, thus manufacturing costs may be reduced.

The pressure roller 62 is capable of moving relative to the heat roller 61, so that the heat roller 61 can be immovable. Thus, loads on the heating device such as a halogen heater, electrodes disposed inside the heating device, and electric lines to be connected to the heating device may be reduced. In the structure where the heating roller 61 is capable of moving, a planetary gear mechanism needs to be installed in the transmission gears 101-105. However, in this embodiment where the pressure roller 62 is capable of moving, installation of a planet gear mechanism in the transmission gears 101 to 105 is unnecessary and can be avoided.

This illustrative embodiment shows, but is not limited to, the structure where the heat roller 61 is connected to the ejection roller 71 via the five transmission gears 101-105. However, the number of the transmission gears is not limited to five. That is, the number of transmission gears is not limited as long as the heat roller 61 and the ejection roller 71 rotate in the same direction by using a gear ratio such that the difference between the peripheral speed of the heat roller 61 and the peripheral speed of the ejection roller 71 is within a specified range such that the peripheral speeds approximate each other.

This illustrative embodiment shows, but is not limited to, the structure where power from the heat roller 61 is transmitted to the ejection roller 71 via the transmission gears 101-105. Instead, power from the heat roller 61 may be transmitted to the ejection roller 72. Alternatively, power from the heat roller 61 may be transmitted to a plurality of ejection rollers, for example, the ejection rollers 71 and 73 (or 74). Furthermore, without provision of the ejection rollers 71, 72, power from the heat roller 61 may be transmitted to the ejection roller 74 (or 73).

This illustrative embodiment shows, but is not limited to, the structure where the transmission gears 101-105 are an example of a driving power transmission member. Instead, other members, such as a roller and a toothed belt, may be used as long as the difference between the peripheral speed of the heat roller 61 and the peripheral speed of the ejection roller 71 is within a specified range and the heat roller 61 and the ejection roller 71 rotate in the same direction. Alternatively, a combination of two or more members such as a gear, a roller, and a belt may be used.

This illustrative embodiment shows, but is not limited to, the structure where the second sensor 82 is disposed on the conveyance path of the sheet P on an upstream side from the facing position between the photosensitive drum 52 and the transfer roller 54. Instead, the second sensor 82 may be disposed on a downstream side of the facing position. The accurate position of the second sensor 82 is not limited. As long as the conveyance speed of the sheet P ejected from the facing position is detected, the second sensor 82 may not be disposed immediately in front of or behind the facing position.

This illustrative embodiment shows, but is not limited to, the structure where the first sensor 81 is disposed on the conveyance path between the fixing unit 6 and the ejection rollers 71, 72. Instead, the first sensor 81 may be disposed on the sheet ejection path 75 between the ejection rollers 71, 72 and the ejection rollers 73, 74 as long as power from the heat roller 61 is transmitted to the ejection rollers 71, 74. Alternatively, if the ejection rollers 71, 72 are omitted and as long as the power from the heat roller 61 is transmitted to the ejection roller 74 (or 73), the first sensor 81 may be disposed on the sheet conveyance path between the fixing unit 6 and the ejection rollers 73, 74

Furthermore, if the ejection rollers 71, 72 are omitted and the power from the heat roller 61 is transmitted to the ejection roller 74 (or 73), the first sensor 81 may be disposed on a downstream side from the ejection rollers 73, 74 in the sheet conveyance direction. With this structure, the difference between the conveyance speed of the sheet P ejected from the ejection rollers 73, 74 and the fixing speed can be set within a specified range, and thus the fixing time can be accurately measured based on the detection by the first sensor 81.

"The ejection rollers 71, 72 are omitted" means a structure where the sheet P is directly conveyed from the fixing unit 6 to the ejection rollers 73, 74 without any rollers for conveying the sheet P being provided between the fixing unit 6 and the ejection rollers 73, 74 in the sheet conveyance direction.

This illustrative embodiment shows, but is not limited to, the structure where the rotation of the pressure roller 62 is controlled based on the difference between the transfer time and the fixing time. Instead, the conveyance speed of the sheet P at the facing position and the conveyance speed of the sheet P ejected from the fixing unit 6 may be calculated from the size of the sheet P (a dimension in the sheet conveyance direction) to be sent along with the printing command and detection results of the respective sensors 81, 82, to find the difference in speed, so that the rotation of the pressure roller 62 may be controlled based on the difference in speed.

This illustrative embodiment shows, but is not limited to, the structure where the second sensor 82 is provided to measure the fixing time. Instead, the second sensor 82 may be omitted if the peripheral speed of the photosensitive drum 52 or the transfer roller 54 (the transfer speed) is constant. In this case, the conveyance speed of the sheet P ejected from the fixing unit 6 (the fixing speed) may be first calculated from the size of the sheet P to be sent along with the printing command and the fixing time obtained from the first sensor 81. The difference between the calculated fixing speed and the transfer speed previously stored in the ROM of the controller 8 may be calculated and the rotation of the pressure roller 62 may be controlled.

This illustrative embodiment shows, but is not limited to, the structure where the pressure roller 62 is supported by the arm member 64, which is capable of pivoting, so that the pressure roller 62 is capable of moving with respect to the frame member 63. A known moving mechanism may be adopted for the pressure roller 62.

This illustrative embodiment shows, but is not limited to, the structure where the transfer roller 54 is used as a transfer member. Instead, a non-contact type transfer member with respect to the photosensitive drum 52 may be used. If the non-contact type transfer member is used, the sheet P may be conveyed at the facing position by the photosensitive drum 52.

The computer readable media can be removable media such as a compact disc (CD), a floppy disk (FD), USB flash memory or other known types of removable or portable storage.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form a developer image on a recording sheet, comprising:

a fixing unit configured to fix the developer image onto the recording sheet by heat, the fixing unit including a pressure roller, a heat roller, and a drive gear fixed to a shaft of the pressure roller, the pressure roller being configured to rotate in response to power from the drive gear, and the pressure roller being configured to contact a peripheral surface of the heat roller and to transmit the power to the peripheral surface of the heat roller such that the heat roller rotates;

an ejection roller configured to eject the recording sheet conveyed from the fixing unit from the image forming apparatus; and a power transmission member configured to transmit the power from the heat roller to the ejection roller such that the ejection roller rotates, the power transmission member including a first gear fixed to a shaft of the heat roller, wherein the drive gear is spaced apart from the first gear.

2. The image forming apparatus according to claim 1, further comprising:

a photosensitive member configured to hold a developer image on a surface thereof;

a transfer member disposed to face the photosensitive member and configured to transfer the developer image held on the surface of the photosensitive member to the recording sheet in a facing position where the transfer member and the photosensitive member face each other;

a first sensor configured to detect passage of the recording sheet conveyed from the fixing unit; and a controller configured to control rotation of the pressure roller responsive to detection of the passage by the first sensor such that a conveyance speed of the recording sheet in the fixing unit is controlled to approximate a conveyance speed of the recording sheet in the facing position.

3. The image forming apparatus according to claim 2, further comprising:

a first power source configured to apply the power to the pressure roller;

a second power source configured to apply power to the photosensitive member;

wherein the first sensor is disposed on a downstream side of the fixing unit and on an upstream side of the ejection roller in a sheet conveyance direction, and wherein the controller controls rotation of the pressure roller via the first power source responsive to the detection of the passage by the first sensor such that the conveyance speed of the recording sheet in the fixing unit is controlled to approximate the conveyance speed of the recording sheet in the facing position.

4. The image forming apparatus according to claim 2, further comprising:

a second sensor configured to detect a leading end and a trailing end of the recording sheet on an upstream or downstream side of the facing position in the sheet conveyance direction, wherein the first sensor is configured to detect the leading end and the trailing end of the recording sheet being conveyed in the sheet conveyance direction, and the control device controls rotation of the pressure roller based on an amount of time between the first sensor detecting the leading end of the recording sheet and the trailing end of the recording sheet, and an amount of time between the second sensor detecting the leading end and the trailing end of the recording sheet.

5. The image forming apparatus according to claim 1, wherein the fixing unit includes a frame member configured to pivotably support the pressure roller.

6. The image forming apparatus according to claim 1, wherein the power transmission member includes a second gear coupled to the first gear and fixed to a rotation shaft of the ejection roller.

7. The image forming apparatus according to claim 6, wherein a gear ratio of the first and second gears is set so that a peripheral speed of the heat roller and a peripheral speed of the ejection roller approximate each other.

8. One or more non-transitory computer readable media having computer executable instructions stored thereon, which when executed by a processor, perform a method of controlling printing comprising the steps of:

measuring a fixing time for fixing an image to a recording sheet between when a leading end of the recording sheet passes a first sensor and when a trailing end of the recording sheet passes the first sensor;

measuring a transfer time for transferring the image to the recording sheet between when the leading end of the recording sheet passes a second sensor and when the trailing end of the recording sheet passes the second sensor;

calculating a difference between the transfer time and the fixing time; and controlling a drive source for driving a fixing unit that transmits power to an ejection roller, based on the difference between the transfer time and the fixing time.

9. The one or more non-transitory computer readable media according to claim 8, wherein the step of controlling includes determining whether the difference between the transfer time and the fixing time exceeds a threshold value;

maintaining a rotation speed of the driving source for a next printing operation to be the same as the rotation speed of the driving source for a current printing operation if the difference does not exceed the threshold value; and modifying the rotation speed of the driving source for the next printing operation if the difference exceeds the threshold value.

10. The one of more non-transitory computer readable media according to claim 9, wherein the modifying includes increasing the rotation speed of the driving source for the next printing operation when the fixing time is greater than the transfer time; and decreasing the rotation speed of the driving source for the next printing operation when the fixing time is less than the transfer time.

11. An image forming apparatus configured to form a developer image on a recording sheet, comprising:

a first gear configured to receive power from a power source;

a first roller configured to rotate in response to the power from the first gear attached to a shaft of the first roller;

a second roller configured to contact the first roller and receive power from the first roller such that the second roller rotates, wherein the first roller and the second roller are configured to fix the developer image onto the recording sheet;

an ejection roller configured to eject the recording sheet conveyed from the first roller and the second roller out of the image forming apparatus; and a power transmission member configured to transmit the power from the second roller to the ejection roller such that the ejection roller rotates, the power transmission member including a second gear fixed to a shaft of the second roller, wherein the first gear is spaced apart from the second gear.

12. The image forming apparatus according to claim 11, wherein the first roller includes a pressure roller, wherein the second roller includes a heat roller having a heating member, and wherein the pressure roller is configured to press the recording sheet to the heat roller such that the developer image is fixed onto the recording sheet by heat from the heating member.

* * * * *